US011772880B2

(12) United States Patent
Doucet et al.

(10) Patent No.: US 11,772,880 B2
(45) Date of Patent: Oct. 3, 2023

(54) SECURE PACKAGE FOR TABLETS

(71) Applicant: A.C.D. (AGENCE COMMERCIALE DOUCET), Rumilly (FR)

(72) Inventors: Eric Doucet, Marcellaz Albanais (FR); Corinne Doucet, Marcellaz Albanais (FR)

(73) Assignee: A.C.D. (Agence Commerciale Doucet), Rumilly (FR)

( * ) Notice: Subject to any disclaimer, the term of this patent is extended or adjusted under 35 U.S.C. 154(b) by 173 days.

(21) Appl. No.: 16/758,687

(22) PCT Filed: Oct. 25, 2018

(86) PCT No.: PCT/EP2018/079240
§ 371 (c)(1),
(2) Date: Apr. 23, 2020

(87) PCT Pub. No.: WO2019/081622
PCT Pub. Date: May 2, 2019

(65) Prior Publication Data

US 2021/0179339 A1 Jun. 17, 2021

(30) Foreign Application Priority Data

Oct. 26, 2017 (FR) ..... 1760101

(51) Int. Cl.
*B65D 83/04* (2006.01)

(52) U.S. Cl.
CPC ..... *B65D 83/0463* (2013.01)

(58) Field of Classification Search
CPC ..... A61J 1/035; B65D 83/0463
See application file for complete search history.

(56) References Cited

U.S. PATENT DOCUMENTS 3,921,804 A * 11/1975 Tester ..... B65D 83/0463 206/531
6,149,029 A * 11/2000 de Meyer ..... A61J 7/0472 221/25
6,155,454 A * 12/2000 George ..... A61J 7/0076 206/531
6,854,618 B2 * 2/2005 Harrold ..... B65D 50/045 206/531

(Continued)

FOREIGN PATENT DOCUMENTS

DE 101 17 910 C1 8/2002
EP 2 216 266 A1 8/2010

(Continued)

OTHER PUBLICATIONS

International Search Report (with English translation) dated Jan. 15, 2019 for International application No. PCT/EP2018/079240.

(Continued)

*Primary Examiner* — Gene O Crawford
*Assistant Examiner* — Kelvin L Randall, Jr.
(74) *Attorney, Agent, or Firm* — Lippes Mathias LLP

(57) ABSTRACT

A secure package (1) intended to receive a blister (3) including at least one tablet located in a dimple (3*a*) closed by a seal (3*b*). The package (1) includes a packaging (2) with longitudinal axis of symmetry (X, X'), defining a lower space in which a movable wall (4) is located connected to a resilient feature (5). The packaging (2) includes at least one upper wall (2*a*) which includes at least a first opening (7) intended to receive the dimple (3*a*), the movable wall (4) and the upper wall (2*a*) defining a recess intended for positioning of the blister (3), the moving wall being intended to adopt two positions, namely a release position for releasing at least one tablet and a closed position intended to close off at least one seal (3*b*), while the moving wall (4) includes at least one second opening (8) which comes to be positioned opposite a first opening (7), namely intended to come to be positioned opposite a seal (3*b*), when the moving wall (4) is in the release position.

3 Claims, 7 Drawing Sheets

(56) References Cited

U.S. PATENT DOCUMENTS

| | | | | |
|---|---|---|---|---|
| 7,950,202 | B2 * | 5/2011 | Kodama | B65B 1/36 53/247 |
| 8,746,454 | B2 | 6/2014 | Doucet et al. | |
| 2003/0057231 | A1 * | 3/2003 | Kim | B65B 9/08 221/263 |
| 2004/0256277 | A1 * | 12/2004 | Gedanke | B65D 83/0463 206/538 |
| 2005/0082194 | A1 * | 4/2005 | Fry | A61J 1/035 206/531 |
| 2009/0038982 | A1 * | 2/2009 | Doucet | B65D 83/0463 206/531 |
| 2009/0283439 | A1 * | 11/2009 | Barndt | B65D 83/0463 206/531 |
| 2012/0125805 | A1 * | 5/2012 | Myszak | B65D 83/0463 206/528 |
| 2020/0383871 | A1 * | 12/2020 | Mehregany | A61J 1/16 |

FOREIGN PATENT DOCUMENTS

| | | | | |
|---|---|---|---|---|
| EP | 2216266 | A1 * | 8/2010 | B65D 83/0463 |
| FR | 2 892 398 | | 4/2007 | |
| WO | WO 03/042066 | A1 | 5/2003 | |

OTHER PUBLICATIONS

Written Opinion of the International Searching Authority (with English translation) dated Jan. 15, 2020 for International application No. PCT/EP2018/079240.

* cited by examiner

SECURE PACKAGE FOR TABLETS

FIELD OF INVENTION

The present invention concerns a secured packaging for pills, intended to accommodate a blister, out of the reach of children, who must perform two simultaneous actions in order to access the medications.

BACKGROUND

Most household accidents occur due to the ingestion of or contact with household products, cosmetics or medications.

In English, "child-resistant packaging" is used to mean packaging that is used to reduce the risk of ingestion of hazardous products by children.

This packaging must resist all attempts at opening by a child less than five years of age, while still being accessible to elderly or handicapped persons, within a reasonable amount of time and with minimum effort.

Usually, the pills are packaged in a secure manner, either in bulk in a bottle whose stopper requires simultaneous movements of relatively excessive pressure and rotation, or in blisters that are part of a secure packaging system that require a specific manipulation in order to release the blister from its packaging.

This packaging does not make it possible, every time a pill is taken, to seal access to the packaging through automatic closure, without having to perform a specific manipulation. If this packaging is not reclosed manually, it may remain open and accessible to unauthorized persons.

This is generally the case, when this packaging is being used by elderly people, who find access to and handling of this packaging to be too constraining on an everyday basis and prefer, after the first use, to either transfer the medications into new standard packaging that is not child-resistant, or to leave the sealed packaging open for the next use.

Safety packaging that includes a means of recall have been developed. This packaging does not require additional manipulation to close them, and requires specific manipulation each time the medication is taken, like in those described in documents EP 2 216 266 and FR 0 510 884.

However, the mobile part of this packaging is the blister itself, which requires either a structure that is specific to the secure packaging, or perforations that are adapted to its attachment to a means of recall.

Because of this, there is a need for safety packaging that is child-resistant and that has a simplified structure, and which makes it possible to include a standard blister.

SUMMARY OF THE INVENTION

The present invention proposes a safety packaging that is child-resistant, making it possible to remedy the abovementioned drawbacks.

Safety packaging that is designed to accommodate a blister is of the type comprising at least one pill located in a dimple that is blocked by a seal, where the said packaging comprises a packaging with a longitudinal axis of symmetry, that bounds an interior space in which there is a moveable wall that is connected to an elastic means, with the said packaging also comprising at least one upper wall that comprises at least one first orifice designed to accommodate the dimple, and where the said moveable wall and the upper wall bound a recess that is designed to position the blister, with the said moveable wall being designed to adopt two positions, namely one position for the release of at least one pill and an obstructing position designed to enclose at least one seal, whereas the moveable wall comprises at least one second orifice which is positioned facing a first orifice, namely designed to be positioned facing a seal, when the moveable wall is in the released position.

According to an additional characteristic, the elastic means comprises an elastic loop.

According to another additional characteristic, the elastic means comprises at least one means of grasping.

It should be noted that the upper wall comprises an opening that makes it possible to access the means of grasping, which projects upwards towards the upper wall.

According to additional characteristics, the elastic means comprises a means of grasping located in the longitudinal axis of symmetry, or even two means of grasping located opposite the longitudinal axis of symmetry, i.e. on either side of this axis.

It should be noted here that the packaging comprises a bottom wall that is arranged transversely to the upper wall, whereas the elastic means comprises a compression stop that is in contact with the bottom wall, whereas the packaging comprises a lower wall that is located opposite the upper wall, with the said lower wall comprising at least one third orifice, with each of the third orifice(s) being aligned with a first orifice of the upper wall.

Other characteristics and advantages of the invention will become apparent from the following description if you look at the attached drawings, which are given only as non-limiting examples.

BRIEF DESCRIPTION OF THE DRAWINGS

FIG. 1 is a partial section perspective view.

FIG. 2 is a top view in a released position.

FIG. 3 is a top view in a blocked position.

FIG. 4 is a section view through line A-A in FIG. 2.

FIG. 5 is a section view through line A-A in FIG. 3.

FIG. 6 is a perspective view.

FIG. 7 is a top view of FIG. 6, with the elastic means at rest.

FIG. 8 is a top view of FIG. 6, with the elastic means stressed in compression.

FIG. 9 is a view in which the elastic means is at rest.

FIG. 10 is a view in which the elastic means is stressed in compression.

FIG. 11 is a view in which the elastic means is at rest.

FIG. 12 is a view in which the elastic means is stressed in compression.

DETAILED DESCRIPTION OF THE INVENTION

Figure 1:
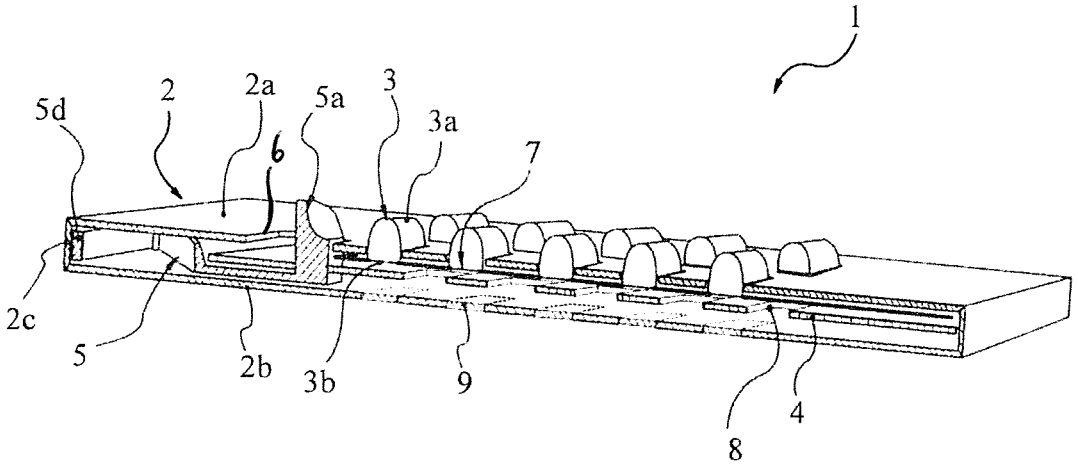
FIGS. 1 through 5 are views of the packaging according to the invention, according to one un manner of embodiment.

This way, safety packaging (1) for pills, that is child-resistant, according to the invention, exists in the form of packaging (2) designed to accommodate a blister (3) held fixed in this latter, whereas it comprises a moveable wall (4) that is connected to an elastic means (5).

The packaging (1) requires two simultaneous manipulations in order to release a pill from a blister (3), as expounded in further detail in the following description.

One blister (3) commonly consists of an upper wall comprising at least one dimple (3*a*) in which one pill is lodged, whereas it comprises one lower wall that is generally made of aluminum and equipped with a seal (3*b*) facing a dimple (3*a*). It is understood that pressure on a dimple causes the breakage of the seal arranged in correspondence with the dimple, releasing the pill.

This packaging (2) exists advantageously as a parallelogram of longitudinal axis of symmetry (X, X') comprising an upper wall (2*a*), lateral walls, notably a bottom wall (2*c*) and advantageously a lower wall (2*b*) or portions of lower wall (2*b*), but there could also be packaging that comprises a primary enclosure in which the elastic means (5) is comprised, whereas the first enclosure is extended by a second enclosure designed to accommodate a blister (3).

According to one means of execution, not shown, the packaging (2) does not comprise lateral walls arranged parallel to the longitudinal axis (X, X'), whereas the upper wall (2*a*) is directly connected to the lower wall (2*b*) of the packaging or to portions of the lower wall (2*b*).

We add here that the upper wall (2*a*) of packaging (2) comprises at least one first orifice (7) intended for the insertion of a dimple (3*a*) of a blister (3).

It should be noted here that the positioning of a blister (3), in which at least one dimple (3*a*) is inserted into a first orifice (7), and holds it in a position that is fixed in translation relative to the upper wall (2*a*) of the packaging (2).

In this way, a first orifice (7), a dimple (3*a*) and a seal (3*b*) are aligned along a common vertical axis.

Packaging (2) bounds an interior space in which a moveable wall (4) is arranged in translation along longitudinal axis (X, X'), connected to an elastic means (5).

Figure 2:
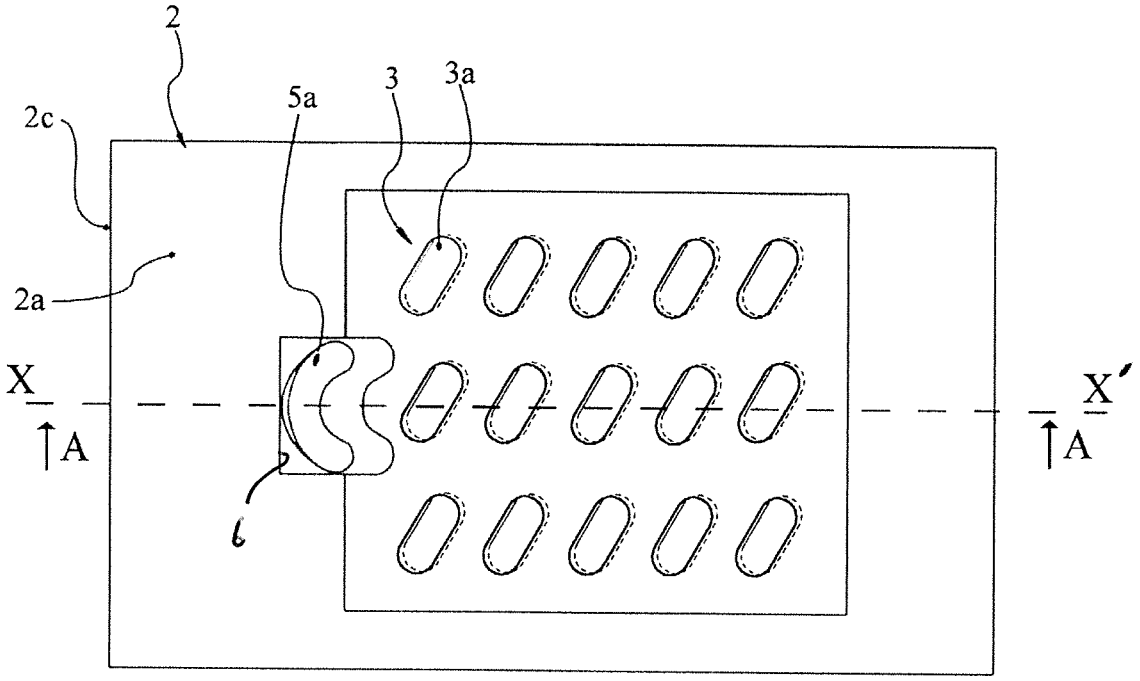
Figure 4:
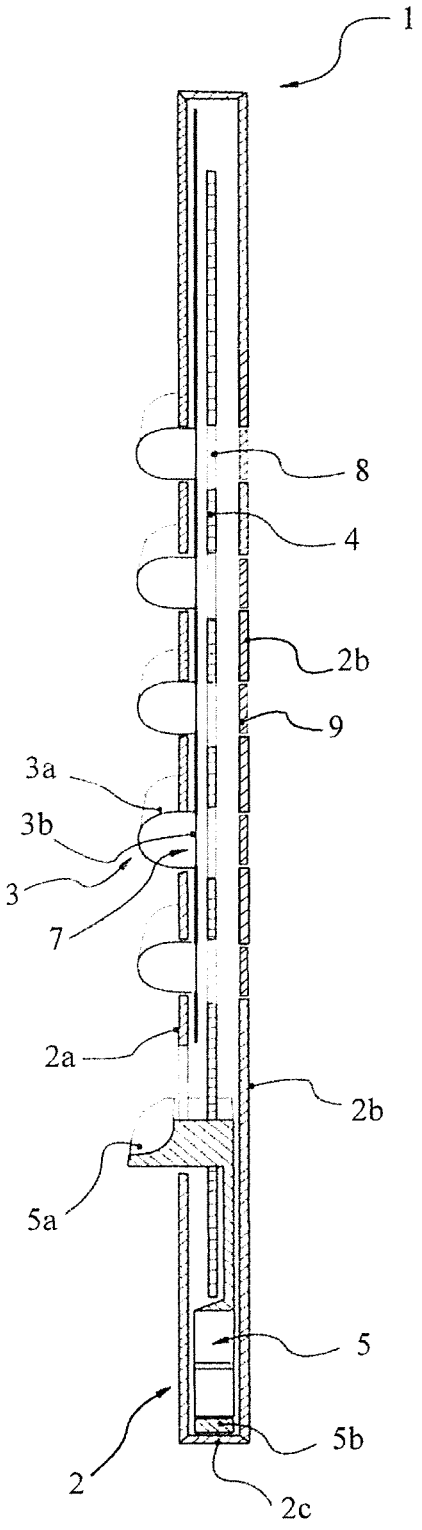
Figure 5:
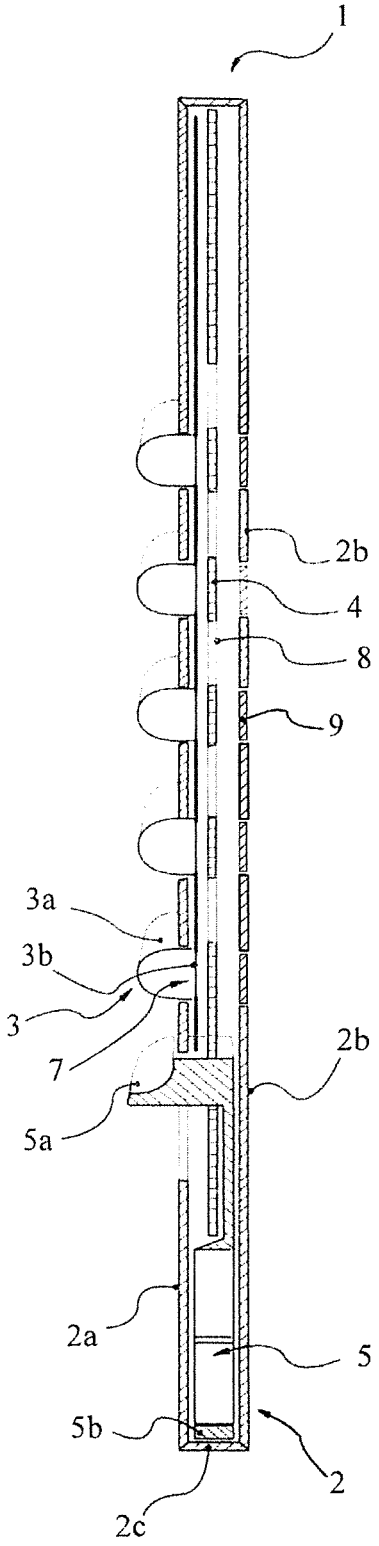
Figure 10:
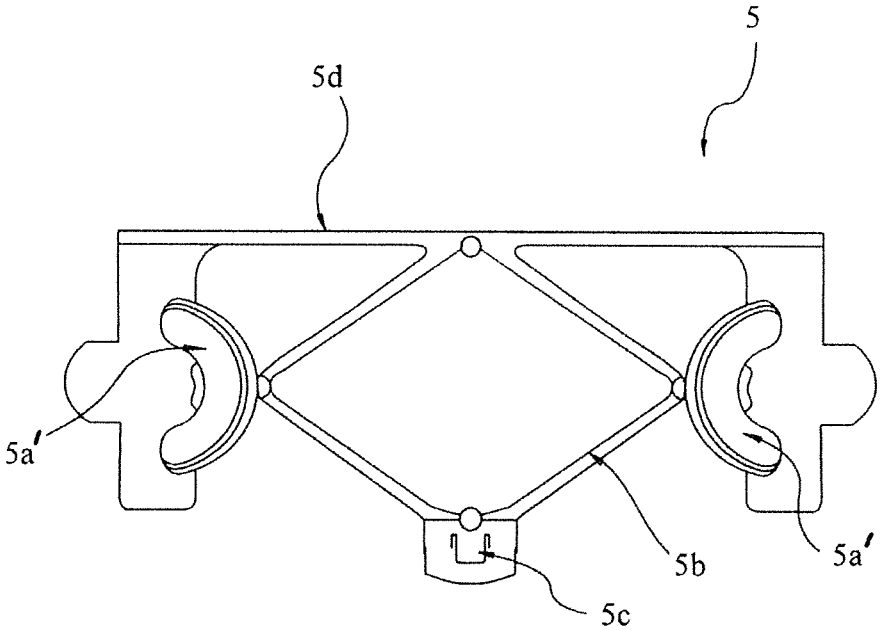

According to one characteristic, the stress of an elastic means (5) in compression, causes the displacement in translation of the moveable wall (4) in a longitudinal direction relative to packaging (2) and to blister (3), namely in the direction of the bottom wall (2*c*) as illustrated in FIGS. 2 and 4, or in a direction opposite the bottom wall (2*c*) according to the manner of embodiment illustrated in FIG. 10, in which the only stress shown is on the elastic means (5).

According to the previous characteristic, depending on the type of elastic means (5) used, namely, depending on the direction of displacement of the mobile wall (4), the arrangement of orifices (7, 8, 9) of the various walls (2*a*, 4, 2*b*) as will be described in greater detail in the remainder of the description, are consequently located.

We note here that the upper wall (2*a*) and the moveable wall (4) bound a housing designed to accommodate the blister (3).

The packaging advantageously comprises a lower wall (2*b*) that is located opposite the upper wall (2*a*), but which could be otherwise, with the packaging (2) comprising a portion of lower wall (2*b*) bounding a lower peripheral rim and an opening that gives access to the lower surface of the moveable wall (4).

We should also add here that the packaging (2) comprises a lower lateral wall (2*c*) that is arranged transversally to upper wall (2*a*).

It should be noted that depending on the manner of embodiment illustrated, the lower wall (2*a*) is equipped with at least one third orifice (9), whereas the third orifice(s) (9) are each aligned with a first orifice (7) of the upper wall (2*a*) arranged in correspondence.

According to one characteristic, the moveable wall (4) comprises at least one second orifice (8) that is bounded by portions of full wall.

It should be understood that a first orifice (7), as well as a second orifice (8) and advantageously a third orifice (9) are of a size and shape that correspond to a seal (3*b*), that makes it possible for a pill to pass through the various orifices (7, 8, 9) when they are aligned along a common vertical axis.

Figure 3:
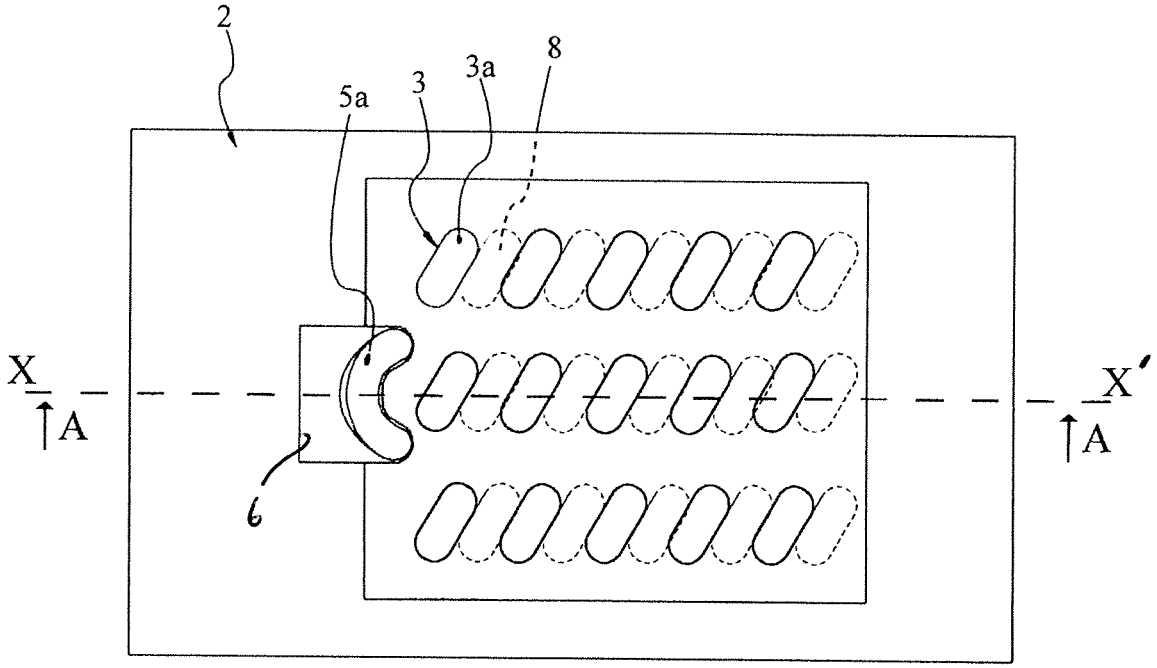

Depending on the manner of embodiment, illustrated in FIGS. 1 through 3, the dimples (3*a*) are oriented along one angle relative to the longitudinal axis (X, X'), it should be understood that the dimples (3*a*) could be arranged in another manner, perpendicularly or parallel relative to the longitudinal axis (X, X').

This way, the moveable wall (4) is designed to adopt two positions, namely one release position in which at least one second orifice (8) is aligned with a first orifice (7) of the upper wall (2*a*) of packaging (2), and an obstructing position in which the second orifice(s) (8) is/are offset relative to the first orifice(s) (7) along a vertical axis, such that the full-wall portions of the moveable wall (4) are designed to enclose at least one seal (3*b*) of the blister (3).

We restate here that the moveable wall (4) is connected to an elastic means (5) that makes it possible for this latter to be moveable in translation along longitudinal axis (X, X') of packaging (2).

The elastic means (5) is included at least partially in the packaging (2), preferably the elastic means (5) is entirely included in the packaging (2) except for the means of grasping (5*a*), as explained in greater detail below.

We note here that the elastic means (5) is connected in a detachable manner to the moveable wall (4). It should also be noted that the elastic means (5) is advantageously an independent part as illustrated in particular in FIG. 6, made of plastic, preferably all in one piece, more preferably obtained through an injection process.

We should add here that the elastic means (5) comprises a compression stop (5*d*), designed to stress the bottom wall (2*c*) of packaging (2), an elastic loop (5*b*) that is extended by at least one means of grasping (5*a*), preferably a means of retaining (5*c*) the moveable wall (4) and advantageously an additional means of retention.

Figure 6:
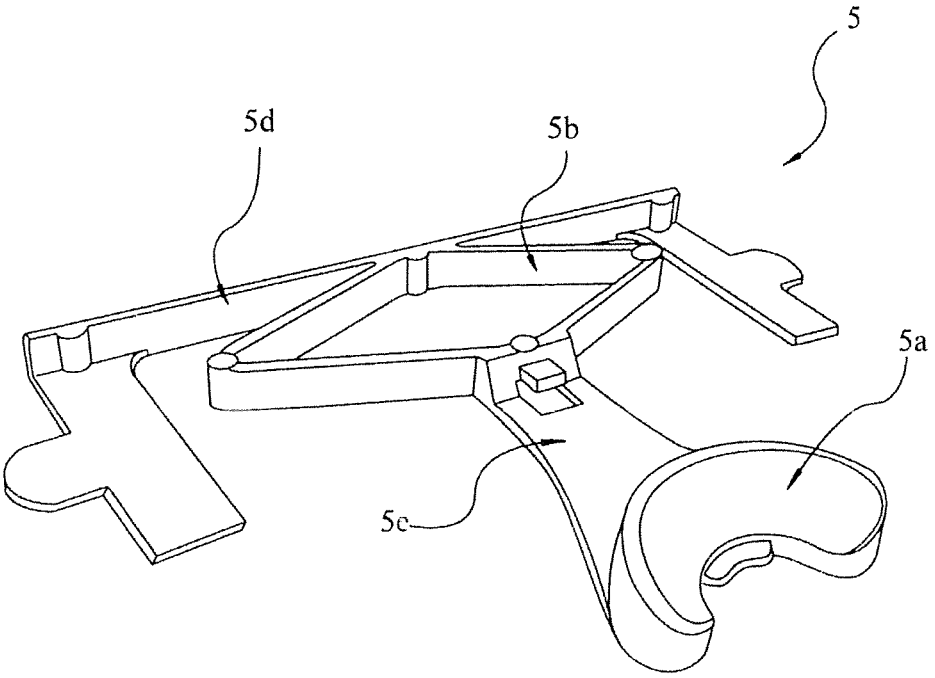
FIGS. 6 through 8 are views of an elastic means according to one manner of embodiment of the invention.
Figure 7:
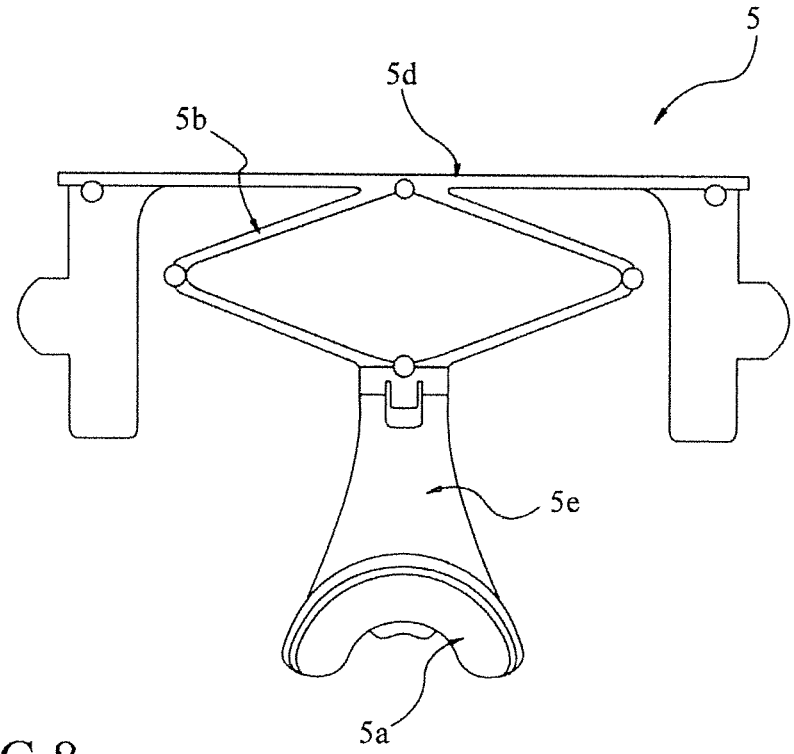
Figure 8:
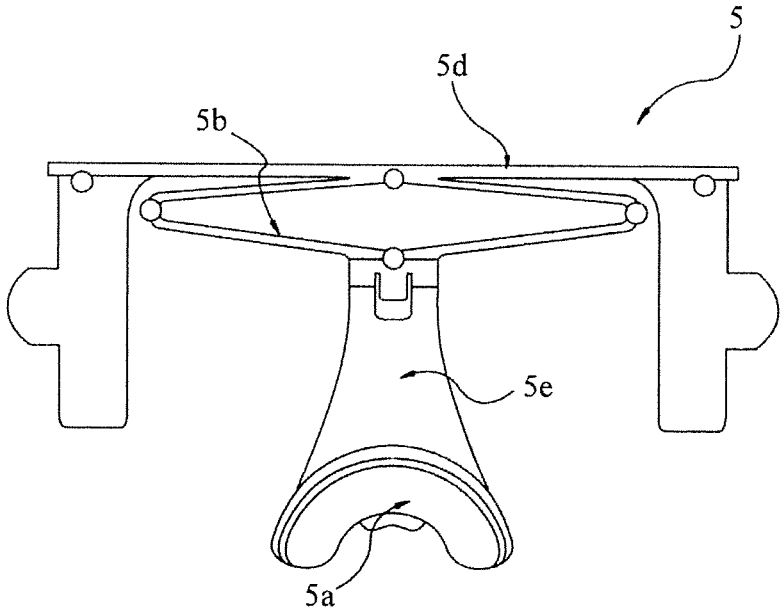

According to the manner of embodiment illustrated in FIG. 6, the elastic loop (5*b*) is extended along longitudinal axis (X, X') by a longitudinal wall (5*e*) which comprises, at its end, a means of grasping (5*a*), whereas the elastic loop (5*b*) is stressed in longitudinal compression, in the direction of the bottom wall (2*c*).

According to the preceding manner of embodiment, the longitudinal wall (5*e*) has a length that is equal to or noticeable equal to that of the elastic loop (5*b*).

According to the preceding manner of embodiment, the means of grasping (5*a*) also contributes to the role of means of holding of the moveable wall (4), in such manner that the moveable wall (4) comprises a bore in which the means of grasping (5*a*) is inserted, whereas the proximal end of the moveable wall (4) comes into contact or largely into contact with the junction of the elastic loop (5*b*) and the longitudinal wall (5*e*).

We should also point out here that according to the manner of embodiment illustrated in FIG. 6, the elastic means comprises an additional means of holding located at the junction of the elastic loop (5*b*) and the longitudinal wall (5*e*), which is presented, as a non-limiting example, as a hook, not shown, directed towards the moveable wall (4) which thus comprises an additional bore that is designed to fit in with the abovementioned additional means of holding.

Figure 9:
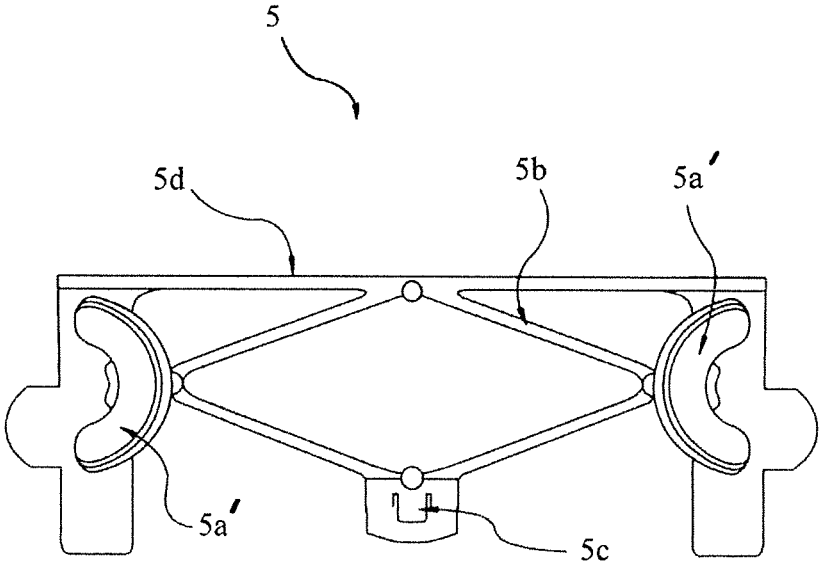
FIGS. 9 and 10 are top views of an elastic means according to another manner of embodiment.

According to another manner of embodiment illustrated in FIGS. 9 and 10, the elastic means (5) comprises two means of grasping (5*a*', 5*a*') located at the lateral extremities of the elastic loop (5*b*), whereas this latter is stressed in transverse compression relative to the longitudinal axis (X, X'), causing the moveable wall (4) to move along longitudinal axis (X, X'), in a direction opposite the bottom wall (2*c*) of packaging (2).

According to the preceding manner of embodiment, the moveable wall (4) is held to the elastic means (5) by a means of retention (5*c*) located at the distal end of the elastic loop (5*b*).

It should be noted that according to the manner of embodiment illustrated in FIG. 10, the means of grasping (5*a*', 5*a*') is subjected to a simultaneous translation motion along longitudinal axis (X, X') and along an axis that is transverse to longitudinal axis (X, X').

Figure 11:
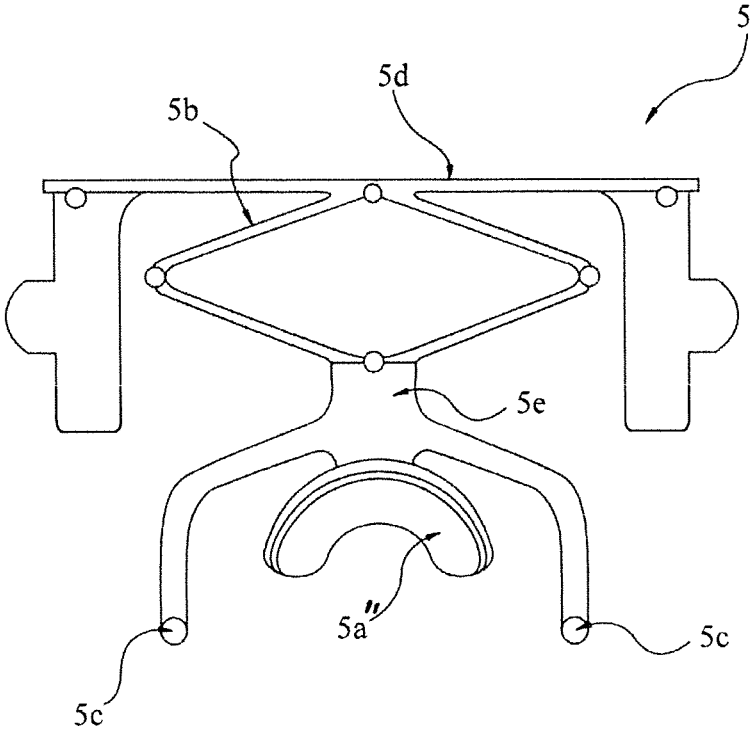
FIGS. 11 and 12 are top views of an elastic means according to one means of execution.
Figure 12:
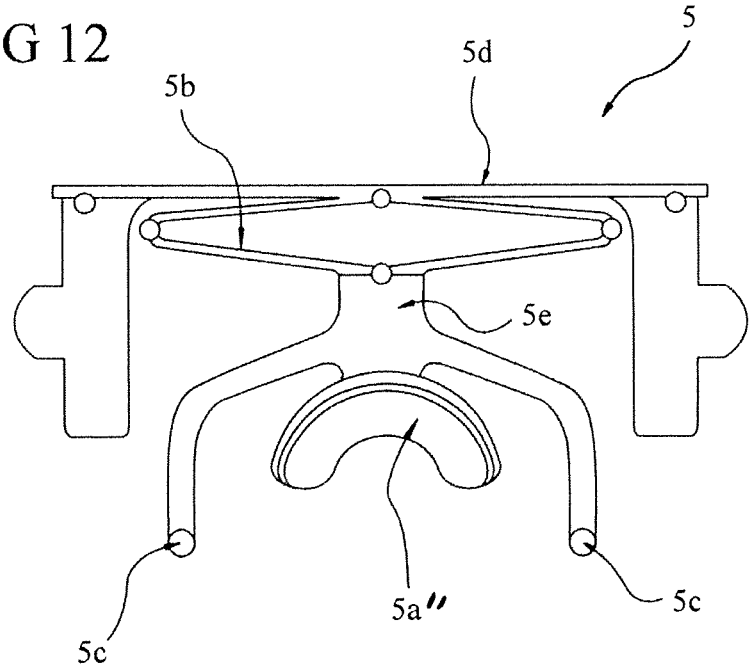

According to one means of execution illustrated in FIGS. 11 and 12, the elastic means (5) comprises two means of retention (5*c*) of the moveable wall (4), connected to the longitudinal wall, and whose distal ends are located past the means of grasping (5*a*"). These means of retention (5*c*) of the moveable wall (4) are shown as two branches which comprise, at their free ends, a projection, for example directed towards the upper wall (2*a*), designed to hold the moveable wall (4) which thus comprises fixation orifices that are correspondingly arranged.

Depending on the preceding manner of execution, the moveable wall (4) does not comprise a bore in which the means of grasping (5*a*, 5*a*', 5*a*") is inserted.

According to one additional characteristic, an elastic means (5) comprises two lateral branches that are arranged parallel to the longitudinal axis (X, X'), as illustrated in FIG. 6, and whose lateral extremities are designed to cooperate with the lateral walls located parallel to the longitudinal axis (X, X'), of packaging (2), in order to contribute to maintaining the elastic means (5) against the stresses that are transverse to the longitudinal axis (X, X').

It should be noted that the upper wall (2*a*) of packaging (2) comprises an opening (6) in which at least one means of grasping (5*a*, 5*a*', 5*a*") projects towards the exterior, making it possible to handle it and, later on, to move it.

In this way, releasing a pill from packaging (1) according to the invention, requires the simultaneous compression of a dimple (3*a*) and of the elastic means (5) towards a release position, in which the moveable wall (4) is positioned such that the first, second and advantageously, third orifices (7, 8, 9) are lined up with at least one seal (3*b*).

It should be understood that the release of the elastic means (5) in compression, automatically repositions the moveable wall (4) in the obstruction position.

It should also be understood that in an obstruction position, any pressure, even excessive, on a dimple (3*a*) makes it impossible to break a seal (3*b*), making it impossible to release a pill.

The invention claimed is:

1. Safety packaging (1), designed to accommodate a blister (3) comprising at least one pill located in a dimple (3*a*) that is obstructed by a seal (3*b*), said packaging (1) comprising a package (2) including a longitudinal axis (X, X'), bounding an interior space in which is located a moveable wall (4) connected to an elastic means (5), with said packaging (2) comprising at least one upper wall (2*a*) which comprises at least one first orifice (7) designed to accommodate the dimple (3*a*), wherein said moveable wall (4) and the upper wall (2*a*) bound a recess;

said moveable wall selectively moveable in translation along said longitudinal axis (X,X') and configured to adopt two positions along said longitudinal axis (X,X'): (i) a release position for the release of said at least one pill from said dimple (3*a*); and (ii) an obstructing position designed to enclose the seal (3*b*) to block release of said at least one pill from said dimple (3*a*);

said moveable wall (4) comprising at least one second orifice (8) which positions itself facing said at least one first orifice (7) so as to be aligned with said seal (3*b*) of said blister (3) when the moveable wall (4) is in the release position;

the elastic means (5) comprising a one-piece independent part that is connected in a detachable manner to the moveable wall (4), said one-piece elastic means comprising an elastic loop (5*b*) and two means of grasping (5*a*') located on opposite sides of the longitudinal axis (X, X');

wherein the two means of grasping (5*a*') that are located on opposite sides of the longitudinal axis (X,X') are situated at lateral extremities of said elastic loop (5*b*);

and wherein said elastic loop (5*b*) is stressed in transverse compression relative to the longitudinal axis (X,X') by inward manual movement of the two means of grasping (5*a*') to cause the movable wall (4) to move along the longitudinal axis (X, X') from said obstructing position to said release position, and wherein release of the elastic means (5) automatically repositions the movable wall in the obstructing position.

2. The packaging (1) according to claim 1, wherein the packaging (2) further comprises a bottom wall (2*c*) that is arranged transversally to the upper wall (2*a*), whereas the elastic means (5) further comprises a compression stop (5*d*) that is in contact with the bottom wall (2*c*).

3. The packaging according to claim 1, wherein the packaging (2) further comprises a lower wall (2*b*) that is located opposite the upper wall (2*a*), with the said lower wall (2*b*) comprising at least one third orifice (9) respectively aligned with said at least one first orifice (7) of the upper wall (2*a*).

* * * * *